US007934981B2

(12) United States Patent
Muggah

(10) Patent No.: US 7,934,981 B2
(45) Date of Patent: May 3, 2011

(54) PATIENT ISOLATION MODULE AND USE THEREOF

(76) Inventor: William David Muggah, Sydney (CA)

( * ) Notice: Subject to any disclaimer, the term of this patent is extended or adjusted under 35 U.S.C. 154(b) by 1281 days.

(21) Appl. No.: 11/504,007

(22) Filed: Aug. 15, 2006

(65) Prior Publication Data

US 2008/0057854 A1 Mar. 6, 2008

(51) Int. Cl.
*F24F 7/06* (2006.01)
*F24F 9/00* (2006.01)

(52) U.S. Cl. ..... 454/341; 454/188; 454/189; 454/190

(58) Field of Classification Search ..... 454/341, 454/188, 187, 189, 190, 191, 192; 600/21
See application file for complete search history.

(56) References Cited

U.S. PATENT DOCUMENTS 3,505,989 A * 4/1970 Truhan ..... 600/21
3,601,031 A 8/1971 Abel et al.
4,063,495 A * 12/1977 Duvlis ..... 454/191
4,129,122 A * 12/1978 Dout et al. ..... 600/21
4,140,105 A * 2/1979 Duvlis ..... 128/847
4,571,904 A * 2/1986 Kessler et al. ..... 52/205
4,603,618 A * 8/1986 Soltis ..... 454/187
5,152,814 A * 10/1992 Nelson ..... 96/224
5,160,517 A * 11/1992 Hicks et al. ..... 55/385.1
6,062,977 A 5/2000 Hague
6,916,238 B2 * 7/2005 Korman ..... 454/187
6,966,937 B2 * 11/2005 Yachi et al. ..... 55/385.2

* cited by examiner

*Primary Examiner* — Steven B McAllister
*Assistant Examiner* — Brittany Towns
(74) *Attorney, Agent, or Firm* — Mario Theriault

(57) ABSTRACT

This patient isolation module has a transparent cubicle mounted over an hospital bed. This cubicle has a rectangular room-air intake opening at one end thereof, and an air treatment unit mounted outside the other end. The air treatment unit has fan inlet openings communicating inside the cubicle and forming a crown over the head of the bed. The air treatment unit draws air from the cubicle and causes a stream of fast-moving air to move along the cubicle, in a toe-to-head direction relative to a patient laying in the hospital bed. The air stream defines a hood-shaped envelope extending over and along both sides of the bed, to better separate a patient's breathing zone from health-care workers standing near that patient's bed.

9 Claims, 2 Drawing Sheets

PATIENT ISOLATION MODULE AND USE THEREOF

FIELD OF THE INVENTION

This invention pertains to portable enclosures that are mountable inside an hospital room to isolate an infectious patient from hospital air. More particularly it pertains to a patient isolation module that is mountable over an hospital bed and that has a hood-shaped air stream there through for enclosing the hospital bed and for capturing germs near their point of discharge.

BACKGROUND OF THE INVENTION

Contagious diseases such as tuberculosis or Severe Acute Respiratory Syndrome (SARS) for example, represent serious concerns to hospital personnel. Many hospitals have central air supply and ventilation systems, in which pathogens can easily mix with hospital air and spread to an entire building through the air ducts of the ventilation system of that building. Also, health-care personnel tending to an infectious patient are exposed to germs carried in a cough or in the exhaled air of that infectious patient. Health-care personnel are also exposed to germs that become airborne from even a slight air movement around the patient's bed. Therefore, health-care personnel and other non-infected patients in hospitals are exposed to relatively high risks of contracting contagious diseases.

It is therefore desirable to isolate an infectious patient in a separate room where the air from that room is filtered and sterilized before it is released into hospital air. However, it is not always feasible to isolate one or more rooms in an hospital and provide each room with its own air control and filtering system, as a preventive measure against the spread of germs.

Therefore, a number of portable sealable enclosures have been developed in the past. These portable enclosures can be deployed in a short time inside an hospital room, to cover an hospital bed and to isolate a patient.

A search in the prior art has yielded several documents disclosing examples of patient isolation modules developed by others. A first example of a patient isolation enclosure is illustrated in U.S. Pat. No. 3,601,031 issued to Kenneth Abel on Aug. 24, 1971. This document describes a portable cubicle which is deployed inside an hospital room. An hospital bed is mounted inside this cubicle. A blower and a HEPA™ filter are mounted along one wall of the cubicle, with the blower discharge opening being mounted near the head of the bed. The blower inlet and discharge louvers are separated from each other by a partition extending alongside the hospital bed. Filtered air is forced to travel over the patient, from head to toes, and around the partition, to return to the blower and to be re-circulated through the filter and back into the cubicle.

Another example of a patient isolation module is described in U.S. Pat. No. 4,129,122 issued to J. A. Dout et al. on Dec. 12, 1978. This document also discloses a sealable enclosure mounted inside an hospital room. A blower discharges clean air over the head of an hospital bed. Foul air is drawn outside the enclosure and back to the blower along the space between the sealable enclosure and the walls and ceiling of the hospital room.

In yet another example, U.S. Pat. No. 6,062,977 issued to S. W. Hague on May 16, 2000, describes a filtering unit mounted on a wall adjacent an hospital bed at the head of the bed. The filtering unit draws air from a region near the head of the bed to entrains contaminants arising from a patient's breathing zone. The potentially contaminated air is filtered, irradiated by UV light and then discharged into hospital air.

Although the air control and treatment systems of the prior art deserve undeniable merits, there continues to be a need for an air control system that can effectively remove potentially contaminated air from above and alongside an infectious patient laying in an hospital bed.

SUMMARY OF THE INVENTION

In the present invention, however, there is provided a patient isolation module comprising a rectangular cubicle mounted over an hospital bed. The cubicle has transparent walls and a ceiling. The patient isolation module also has a rectangular room-air intake opening at one end of the cubicle, and an air treatment unit mounted at the other end. The air treatment unit has fan inlet openings forming a crown over the head of the bed. The air treatment unit draws air from the cubicle and causes a stream of fast-moving air to circulate along the cubicle between the room-air intake opening and the fan inlet openings.

The air stream is aligned with the longitudinal axis of the bed, so that the bed creates an obstruction therein. The air stream is directed from toes to head relative to a patient laying in the hospital head. The shape of the fan inlet openings, the shape of the room-air intake opening, the direction of the air stream, and the placement of the bed along the air stream, causes the air stream to define a hood-shaped envelope of fast-moving air extending over and along both sides of the bed.

This hood-shaped stream of fast-moving air extending over and alongside the hospital bed has better ability to capture and to carry away contagious pathogens projected from the breath or coughs of a patient. This air stream also has better ability to capture and entrain airborne microorganisms that are raised from the patient body, clothes and from the hospital bed by simple air movement near the bed. The hood-shaped air stream as described herein offers better protection to health-care personnel standing near or tending to, an infectious patient, by capturing germs close to their point of discharge and entraining these germs away from the patient and from the health-care workers.

In use, the patient isolation module according to the present invention provides an envelope of fast-moving air to separate a patient's breathing zone from health-care workers standing near that patient's bed. Because of the toe-to-head airflow direction, infectious particles released from a patient are concentrated in the downstream side of the air stream relative to the head of the bed, such that health-care workers standing near the bed are continually swept with clean hospital air.

In yet another aspect of the present invention, there is provided a method for isolating an infectious patient laying in an hospital bed. This method comprises the steps of, enclosing the hospital bed inside a cubicle; generating a hood-shaped stream of fast-moving air inside the cubicle over and alongside the hospital bed, from foot to head relative to the hospital bed and, disinfecting the potentially contaminated air in an air treatment unit adjacent the head of the hospital bed, before discharging disinfected air into hospital air.

This brief summary has been provided so that the nature of the invention may be understood quickly. A more complete understanding of the invention can be obtained by reference to the following detailed description of the preferred embodiment thereof in connection with the attached drawings.

BRIEF DESCRIPTION OF THE DRAWINGS

One embodiment of a patient isolation module according to the present invention is illustrated in the accompanying drawings, in which the same numerals denote the same parts.

DESCRIPTION OF THE PREFERRED EMBODIMENT

Figure 1:
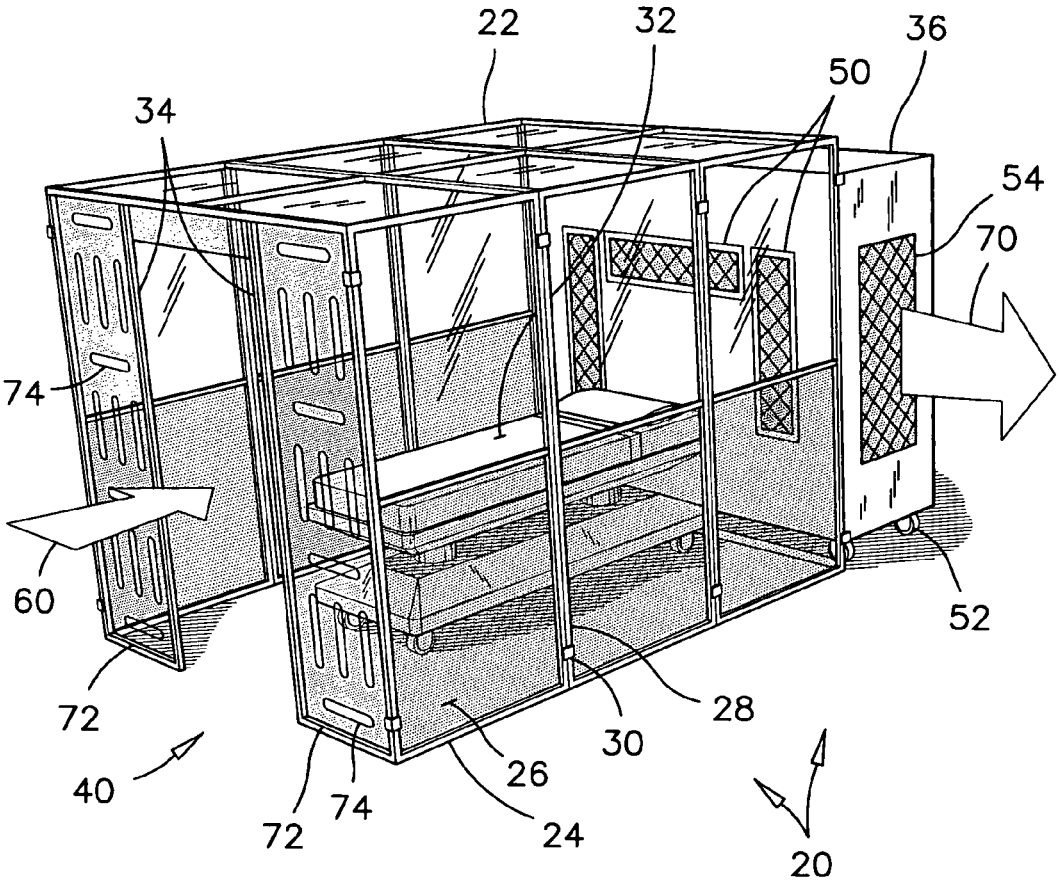
FIG. 1 is a perspective front, right side, and top view of a patient isolation module according to the preferred embodiment of the present invention.

While this invention is susceptible of embodiment in many different forms, there are shown in the drawings and will be described in details herein one specific embodiment of a patient isolation module, with the understanding that the present disclosure is to be considered as an example of the principles of the invention and is not intended to limit the invention to the embodiment illustrated and described.

The patient isolation module 20 according to the preferred embodiment of the present invention is illustrated in its entirety in FIG. 1. The preferred patient isolation module 20 firstly comprises a cubicle 22 that has side walls and a ceiling. The side walls and the ceiling are preferably made of glass or Plexiglass™ panels 24 or other similar transparent panes 26 enclosed in respective metal frames 28 such that they are easily cleaned and sterilized, and they let light pass through.

The panels 24 are held together by clamps 30 that are preferably easily worked by hand without tool. Additional structural details of the panels 24 and of the clamps 30 are not provided herein because these details are well known in the art and do not constitute the essence of the present invention.

In use, the rectangular cubicle 22 encloses an hospital bed 32. The patient isolation module 20 has a door frame 34 at one end of the cubicle 22 and an air treatment unit 36 at the other end. The door frame 34 defines an opening that remains open at all times and constitutes a room-air intake opening 40, for drawing hospital air into the cubicle 22.

The air treatment unit 36 is mounted against the end of the cubicle 22 opposite the room-air intake opening 40, and is sealed against the end wall so that air cannot enter the cubicle 22 through that end wall. The cubicle 22 also has sealed side walls and ceiling.

The air treatment unit 36 contains one or more fans or air blowers (not shown) and three fan inlet openings 50 arranged in a horseshoe configuration. The fan inlet openings 50 communicate with the space inside the cubicle 22, through the end wall facing the room-air intake opening 40. The preferred patient isolation module 20 is installed over an hospital bed 32, so that the fan inlet openings 50 are near the head of the bed 32, and form a crown over the head of the bed 32, when the openings 50 are seen from the foot of the bed 32.

The preferred air treatment unit 36 further has one or more HEPA™ filters therein (not shown) and one or more ultraviolet lights (not shown) to disinfect the air passing there through. The preferred air treatment unit 36 has casters 52 thereunder and a clean air discharge opening 54 on the side thereof outside the cubicle 22. It should be noted that the clean air discharge opening 54 or an additional clean air discharge opening (not shown) may be paced on the top of the air treatment unit 36.

The preferred air treatment unit 36 also has a compartment therein (not shown) for stowing the clamps 30 and all the wall and ceiling panels 24 of the cubicle 22 therein, in a stacked side-by-side arrangement. The preferred air treatment unit 36 also has dimensions to allow it to be moved through a standard single hospital door opening and on standard hospital elevators. The patient isolation module 20 in its collapsed and stowed mode can be easily moved through an hospital and deployed in a room over a patient's bed in a short time without tools.

In use, the air entering the cubicle 22, referred to as room air 60 travels over the hospital bed 32 from the foot of the bed to the head and enters the air treatment unit 36 through the fan inlet openings 50. The potentially contaminated air is treated inside the air treatment unit 36 and the disinfected air 70 is then discharged into hospital air.

The fan (not shown) of the air treatment unit 36 is equipped with a variable speed controller. Preferably, the air treatment unit 36 is designed to create 200 or more air changes per hour inside the cubicle 22. The air treatment unit 36 and the room-air intake opening 40 are designed so that the air velocity through the room-air intake opening 40 is at least 100 feet per minute in a patient-awake mode and at least 75 feet per minute during a patient-resting mode.

Preferably, the end wall of the cubicle 22, surrounding the door frame 34 comprises two end panels 72 which have several ventilation holes or slots 74 therein, evenly spaced over their surfaces. The purpose of these ventilation openings 74 is to prevent the formation of turbulence or vortex of air near the room-air intake opening 40, and to prevent the possibility of entrapping contaminated air near the door frame 34.

In the preferred patient isolation module 20, the cubicle 22 has a length of 114 inches and a width and height of about 87 inches. The room-air intake opening 40 preferably has an area of about 20 square feet, and the fan inlet openings 50 have a total surface of about 6 square feet. The reason for this is to accelerate the air flowing through the cubicle by a factor of at least 3:1, to effectively and swiftly entrain potentially contaminated air into the air treatment unit 36.

In that respect, it has been found through tests that vapour droplets less than 5 microns in size, such as the particles in a cough, that are projected at countercurrent in the air stream at a speed equivalent to a normal cough, do not travel more than about three feet from their point of discharge before being entrained into the air stream and into the air treatment device 36. Because of this feature, health-care personnel can approach and infectious patient with less risk of becoming contaminated by exposition to the patient's exhaled air or similar airborne infectious substances.

It has been found that the air velocities present in the air stream as mentioned herein before are still within a laminar mode such that all airborne contaminants are effectively carried away from the patient in an air stream that has minimum or no turbulence and very few or no air vortex.

Figure 2:
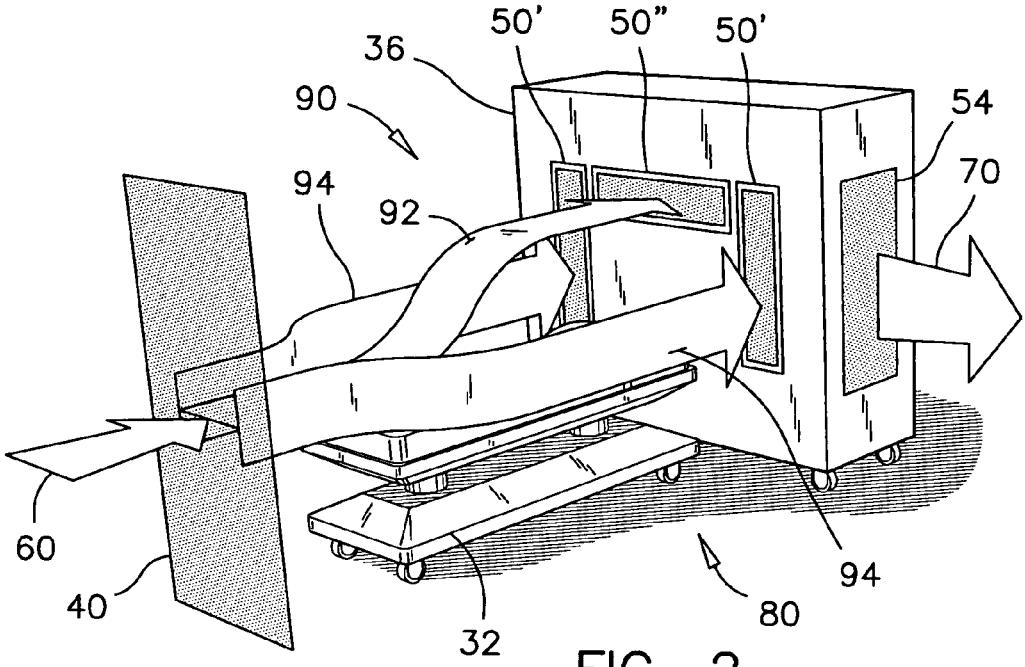
FIG. 2 is a perspective front, right side, and top view of the air stream inside the cubicle of the preferred patient isolation module, as seen without the walls or ceiling of the cubicle.
Figure 3:
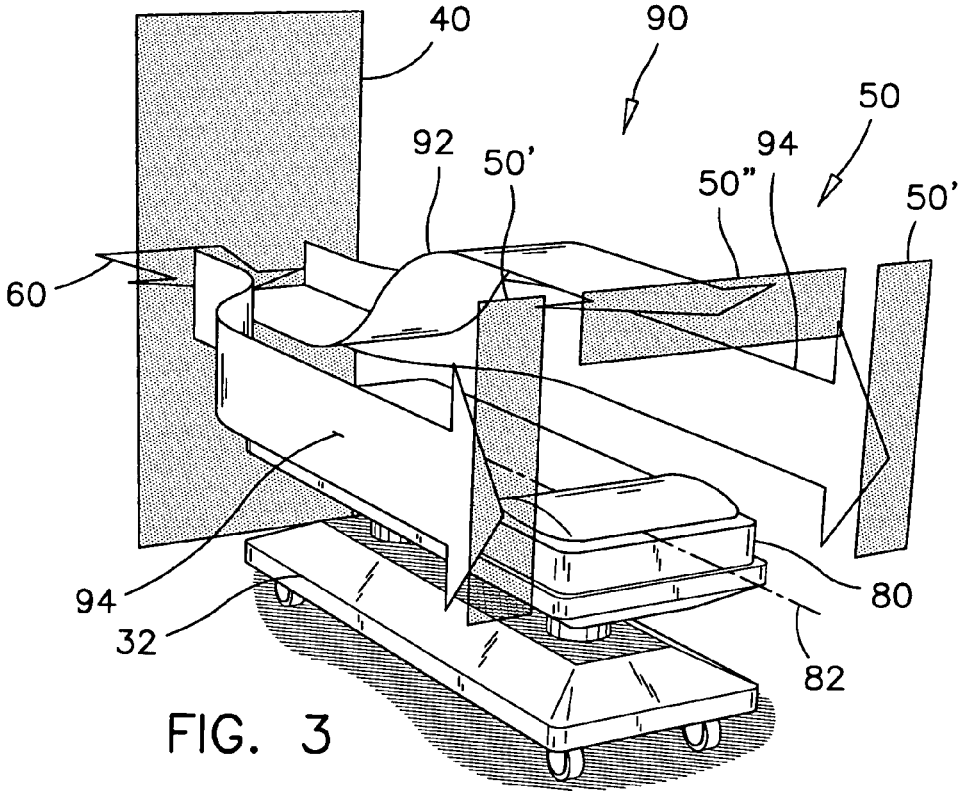
FIG. 3 is a perspective rear, right side, and top view of the air stream inside the cubicle of the preferred patient isolation module, as seen without the walls or the ceiling of the cubicle or the air treatment unit of the preferred module.

Referring now to FIGS. 2 and 3, the air stream through the cubicle 22 of the preferred patient isolation module 20 is illustrated therein. In these drawings, the panels of the cubicle are not illustrated to provide more clarity. Similarly the air treatment unit is not illustrated either in FIG. 3, for more clarity.

In the preferred patient isolation module 20, the hospital bed 32 is aligned with the air stream, and the head 80 of the bed is positioned adjacent to the fan inlet openings 50. The fan inlet openings 50 form a horseshoe-like pattern around and over the head 80 of the bed 32. The fan inlet openings 50 are made of two vertical openings 50' and one horizontal opening 50" extending between the two vertical openings 50'. All the openings 50', 50" have a rectangular shape and about a same surface, such that the air drawn through each opening is substantially the same.

Although the overall horseshoe shape of the fan inlet openings 50 is horizontally centred over the longitudinal axis 82 of the bed 32, these openings jointly enclose the head 80 of the bed without any one of the openings 50', 50" being directly inline with the longitudinal axis 82. The room-air intake opening 40 is also positioned inline with the longitudinal axis 82 of the bed 32.

The hospital bed 32 creates an obstruction in the air stream and causes the air stream to separate in three main components, substantially as illustrated in FIGS. 2 and 3. The horseshoe shape of the fan inlet openings 50, and the placement of the hospital bed 32 directly inline with the air stream causes the flow of room air 60 to separate and to form a hood-shaped stream 90 of air extending over and alongside the bed, for enclosing the head 80 of the bed 32 and the breathing zone of a patient lying in that bed.

This hood-shaped air stream 90 is better defined by a central air current 92 travelling from the room-air intake opening 40 to the horizontal fan inlet opening 50". The central air current 92 is enclosed between two side air currents 94 each travelling from the room-air intake opening 40 to a respective one of the vertical fan inlet openings 50'. It will be appreciated that only three air currents 92, 94 are illustrated herein for clarity and for simplification of the aeromechanics involved. In reality, however, there could be additional air currents forming the hood-shaped air stream 90.

Because of the horseshoe shape of the fan inlet openings 50, the air moving along the aforesaid air currents 92, 94, has a larger velocity that the air moving high near the ceiling of the cubicle or low along the floor, for example. Also because of the configuration of the preferred patient isolation module 20, the air velocity at the surface of the bed 32 is somewhat smaller than the air velocity along the air currents 92, 94. Consequently, the air moving along the patient's face and head causes less noise or discomfort to the patient than a similar installation having a single fan inlet opening aligned with the axis 82 of the bed.

The configuration of the hood-shaped air stream 90 makes it difficult for infectious particles to escape outside the envelope defined by this air stream. Because of this configuration and the increasing air velocity in this air stream 90, healthcare workers standing in a typical position near the bed, on the upstream side of the air currents 92, 94 relative to the patient's head, can approach an infectious patient and treat that patient with less risk of being in contact with bacteria-contaminated air.

As to other instructions related to the installation and operation of the preferred patient isolation module, the same should be apparent from the above description and accompanying drawings, and accordingly no further discussion relative to that aspect is provided.

While one embodiment of the present invention has been illustrated in the accompanying drawings and described herein above, it will be appreciated by those skilled in the art that various modifications, alternate constructions and equivalents may be employed without departing from the true spirit and scope of the invention which is defined by the appended claims.

What is claimed is:

1. A patient isolation module comprising;

a hospital bed;

a cubicle having walls and a ceiling enclosing said hospital bed; a room-air intake opening at one end of said cubicle, and an air treatment unit mounted on an opposite end of said cubicle relative to said one end;

said air treatment unit having fan inlet openings near a head of said hospital bed, said fan inlet openings comprising a horizontal opening extending horizontally above said head of said hospital bed and two vertical openings extending vertically downward from said horizontal opening on respective sides of said hospital bed; and means including said hospital bed and said fan inlet openings for forming a hood-shaped air stream having a horseshoe cross-section extending over and along both sides of said hospital bed wherein said air intake opening is three times as large as said fan inlet openings and the vertical openings extend below a surface of said hospital bed.

2. The patient isolation module as claimed in claim 1, wherein said room-air intake opening and said fan inlet openings are aligned along a longitudinal axis of said hospital bed.

3. The patient isolation module as claimed in claim 2, wherein said horizontal opening and said vertical openings have a same surface.

4. The patient isolation module as claimed in claim 3, wherein said room-air intake opening has a rectangular shape.

5. The patient isolation module as claimed in claim 4, wherein said means for causing an air flow has means for causing and air flow of 100 feet per minute through said room-air intake opening.

6. The patient isolation module as claimed in claim 1, wherein said room-air intake opening is a door on said cubicle.

7. The patient isolation module as claimed in claim 1, wherein said one end has panels bordering said room-air intake opening and said panels have ventilation holes therein.

8. The patient isolation module as claimed in claim 1 wherein said vertical openings are horizontally centered with a longitudinal axis of said bed.

9. The patient isolation module as claimed in claim 1, wherein said air treatment module has an HEPA™ filter and an ultraviolet light mounted therein, and a treated air discharge opening outside said cubicle.

* * * * *